US006193567B1

(12) United States Patent
Hsieh

(10) Patent No.: US 6,193,567 B1
(45) Date of Patent: Feb. 27, 2001

(54) FEMALE TERMINAL FOR PRINTED CIRCUIT BOARD

(75) Inventor: Shao Chung Hsieh, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/405,763

(22) Filed: Sep. 27, 1999

(51) Int. Cl.[7] ..... H01R 11/22
(52) U.S. Cl. ..... 439/853; 439/84
(58) Field of Search ..... 439/850–853, 439/844, 84, 741

(56) References Cited

U.S. PATENT DOCUMENTS

| | | | | |
|---|---|---|---|---|
| 4,299,436 | * | 11/1981 | Ackerman | 439/84 |
| 5,064,379 | * | 11/1991 | Ryll et al. | 439/81 |
| 5,259,796 | * | 11/1993 | Yamada et al. | 439/843 |
| 5,415,571 | * | 5/1995 | Lutsch | 439/843 |
| 5,975,963 | * | 11/1999 | Higuchi et al. | 439/851 |
| 6,000,974 | * | 12/1999 | Hotea | 439/851 |

* cited by examiner

*Primary Examiner*—Brian Sircus
*Assistant Examiner*—Son V. Nguyen
(74) *Attorney, Agent, or Firm*—Richard A. Jones

(57) ABSTRACT

This invention provides a female terminal of one-piece construction for a printed circuit board in which the rectangular receptacle has an interlock arrangement that reduces the length of the open seam at the fourth corner of the rectangular receptacle. The interlock arrangement is accomplished by fabricating one side wall of interlocking segments that are integrally attached to opposite end walls of the rectangular receptacle so that the open seam does not run the entire length of the receptacle. The interlocking side wall segments are preferably shaped to minimize the size of the sheet metal blank to save material and reduce manufacturing costs. The contact tongues of the female terminal are also preferably shaped to provide one or more of the following features—an open and controlled contact gap to lower terminal engage force while maintaining a stable contact force; over stress projection; and double sided mating capability. The solder tabs are also preferably shaped to lock with the printed circuit board mechanically to provide over stress protection on the solder joint.

9 Claims, 1 Drawing Sheet

FEMALE TERMINAL FOR PRINTED CIRCUIT BOARD

FIELD OF THE INVENTION

This invention relates generally to female terminals for printed circuit boards.

BACKGROUND OF THE INVENTION

Female terminals for printed circuit boards typically comprise a rectangular receptacle and confronting contact tongues that are located inside the receptacle for contacting opposite sides of a mating blade terminal that is inserted into the receptacle. Such terminals are usually attached to the printed circuit board by solder tabs that depend from the receptacle and establish an electrical connection with a conductor of the printed circuit board through a solder joint. The terminal is typically of one piece sheet metal construction and made from a stamped metal blank that has a flat receptacle forming portion. The rectangular receptacle is typically made in a forming operation where the flat receptacle forming portion of the blank is bent into rectangular shape by three bending operations that form three comers of the rectangle. These bending operations form four orthogonally related walls that bring the two edges of the receptacle forming portion adjacent to each other to form an open seam at the fourth corner.

A drawback of this type of construction is that the gap at the open seam can widen or increase after an extended period of use increasing the size of the receptacle. This diminishes the contact pressure of the contact tongues inside the receptacle and may result in poor electrical contact with the male blade terminal that is inserted into the receptacle.

SUMMARY OF THE INVENTION

This invention provides a female terminal of one-piece construction for a printed circuit board in which the rectangular receptacle has an interlock arrangement that reduces the length of the open seam at the fourth corner of the rectangular receptacle and the tendency to increase the size of the receptacle after an extended period of use. The interlock arrangement is accomplished by fabricating one side wall of interlocking segments that are integrally attached to opposite end walls of the rectangular receptacle so that the open seam does not run the entire length of the receptacle. The interlocking side wall segments are preferably shaped to minimize the size of the sheet metal blank to save material and reduce manufacturing costs. The contact tongues of the female terminal are also preferably shaped to provide one or more of the following features—an open and controlled contact gap to lower terminal engage force while maintaining a stable contact force; over stress projection; and double sided mating capability. The solder tabs are also preferably shaped to lock with the printed circuit board mechanically to provide over stress protection of the solder joint.

BRIEF DESCRIPTION OF THE DRAWINGS

The present invention will now be described, by way of example, with reference to the accompanying drawing, in which.

DESCRIPTION OF THE PREFERRED EMBODIMENT

Figure 1:
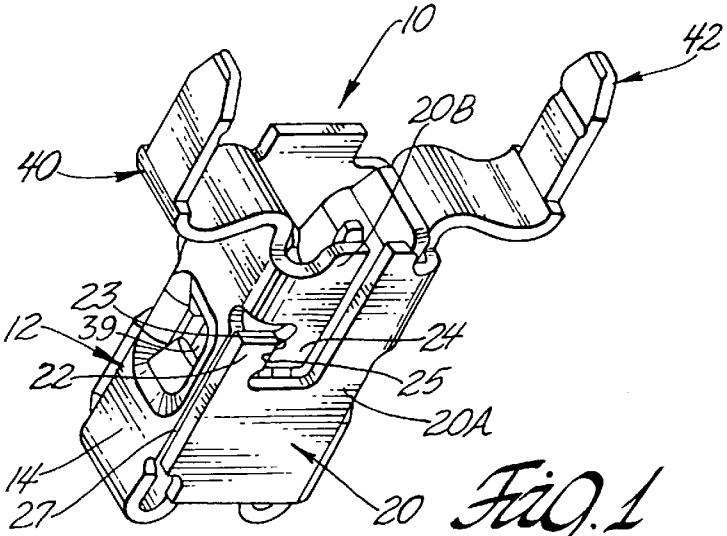
FIG. 1 is a perspective view of a female terminal in accordance with the invention.
Figure 4:
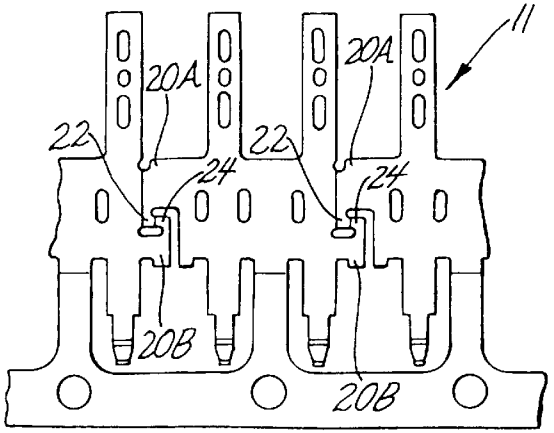
FIG. 4 is a plan view of a sheet metal blank for making the female terminal shown in FIGS. 1, 2 and 3.

Referring now to FIG. 1, the preferred embodiment of the invention is illustrated as a female terminal 10 of one-piece sheet metal construction that is fabricated from a stamped sheet metal blank 11 shown in FIG. 4. Terminal 10 has a receptacle portion 12 of generally rectangular cross section comprising narrow end walls 14 and 16 and wide side walls 18 and 20.

Figure 2:
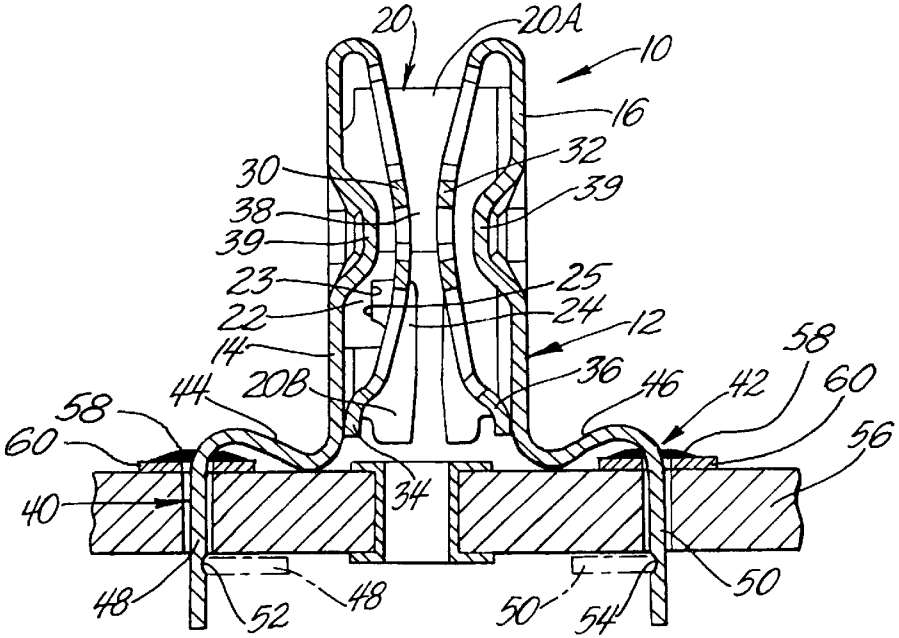
FIG. 2 is a longitudinal section of the female terminal shown in FIG. 1 attached to a printed circuit board.
Figure 3:
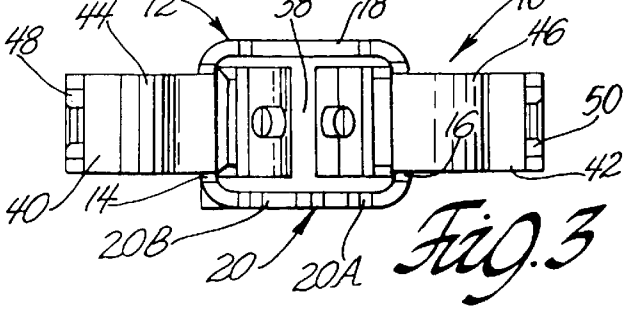
FIG. 3 is a bottom view of the female terminal shown in FIGS. 1 and 2.

Side wall 18 is integrally connected to end walls 14 and 16 at its opposite edges as best shown in FIG. 3. Side wall 18 is preferably imperforate. Side wall 20 comprises interlocking side wall segments 20A and 20B as best shown in FIG. 1 and the blank 11 for a plurality of terminals shown in FIG. 4. Side wall segment 20A is integrally connected to side wall 16 along one edge, the right edge as shown in FIGS. 1, 2 and 3. An opposite lower corner of side wall segment 20A is cut-out to shorten the opposite portion longitudinally and to provide a longitudinal interlock tab 22 that has an interlock shoulder 23 that faces inwardly. The opposite shorter edge of side wall segment 20A is adjacent the side edge of end wall 14 and forms an open seam 27.

However, the open seam 27 does not run the entire length of receptacle 12 because side wall segment 20B is integrally connected to side wall 14. Side wall segment 20B is also shaped to include a longitudinal interlock tab 24 that fits inwardly of interlock tab 22 of side wall segment 20A. Tab 24 has an interlock shoulder 25 that faces outwardly. Tabs 22 and 24 engage along the confronting interlock shoulders 23 and 25 to prevent side walls 14 and 16 from spreading apart at the side of the receptacle 12 that has the open seam 27, that is at the left side of receptacle 12 as viewed in FIG. 3.

Female terminal 10 has left and right longitudinal contact tongues 30 and 32 disposed in receptacle 12. Contact tongue 30 is integrally connected to end wall 14 at an upper edge and curves back into receptacle 12 where the free end 34 engages the inner surface of end wall 14. Contact tongue 32 is integrally connected to end wall 16 and curves back into receptacle 12 where the free end 36 engages the inner surface of end wall 16. Contact tongues 30 and 32 are bow shaped and converge to provide a controlled throat gap 38 in the middle of receptacle 12. Contact tongues 30 and 32 converge toward gap 38 from either end of receptacle 12 as best shown in FIG. 2. Each tongue preferably has an aperture at gap 38 while the two converging portions of each tongue on opposite sides of gap 38 preferably have longitudinal slots to increase flexibility and improve electrical contact with a male blade terminal (not shown) that is inserted into receptacle 12. Upper and lower walls 14 and 16 each have a medial indentation 39 aligned with gap 38 to limit depression of contact tongues 30 and 32 and widening of gap 38.

Terminal 10 has two attachment tabs 40 and 42. Attachment tab 40 and 42 comprise lateral S-shaped sections 44 and 46 that are attached to the lower ends of the side walls 14 and 16 respectively. Longitudinal sections 48 and 50 are attached to the outboard ends of sections 44 and 46 respectively. Longitudinal sections 48 and 50 have respective fold lines 52 and 54.

Female terminal 10 is attached to a printed circuit board 56 by inserting longitudinal sections 48 and 50 into slots extending through the printed circuit board 56 until the inboard ends of S-shaped sections 44 and 46 engage the upper surface of the printed circuit board as best shown in FIG. 2. Longitudinal sections 48 and 50 are then folded over toward each other at fold lines 52 and 54 to engage the lower surface of the printed circuit board 56 with the S-shaped sections 44 and 46 depressed slightly. This provides a mechanical lock that fastens female terminal 10 securely to the printed circuit board 56. After the female terminal 10 is fastened to the printed circuit board, a solder joint 58 is made with a conductor 60 of the printed circuit board 56. The solder joint 58 is protected against over stress by virtue of the mechanical lock of the tabs 48 and 50 to the printed circuit board 56 along with the S-shaped spring on section 44 and 46 which seat on top of the printed circuit board 56. Once the female terminal 10 is securely fastened and soldered to the printed circuit board, a mating male blade terminal (not shown) can be inserted into receptacle 12 from either end, that is from above or from below the printed circuit board 56 to establish an electrical connection due to the shape of contact tongues 30 and 32.

What is claimed is:

1. A female terminal of one-piece construction for a printed circuit board having a rectangular receptacle and a pair of confronting contact tongues that are located inside the receptacle, the rectangular receptacle having four walls including three walls that are each integrally attached to two adjacent walls of the four walls, and the four walls of the rectangular receptacle including a fourth wall of two interlocking segments that are integrally attached to two respective adjacent walls of the four walls so that the rectangular receptacle does not have an open seam between any two adjacent walls of the four walls that runs an entire length of the receptacle, and solder tabs that depend from the receptacle for fastening the female terminal to the printed circuit board, the solder tabs of the female terminal being shaped to interlock with the printed circuit board mechanically to provide over stress protection for a solder joint between the female terminal and a conductor of the printed circuit board.

2. The female terminal as defined in claim 1 wherein the contact tongues of the female terminal are bow shaped to provide an open and controlled contact gap to lower terminal engage force while maintaining a stable contact force.

3. The female terminal as defined in claim 1 wherein the contact tongues of the female terminal are each shaped to contact one of the four walls of the rectangular receptacle to provide over stress protection.

4. The female terminal as defined in claim 1 wherein the contact tongues are bow shaped in a longitudinal direction and converge toward each other so that a mating blade terminal can be inserted into the receptacle between the contact tongues from either longitudinal direction.

5. A female terminal of one-piece construction for a printed circuit board comprising, a rectangular receptacle having a pair of narrow end walls that are opposite each other and a pair of wide side walls that are opposite each other, a pair of confronting contact tongues that are integrally connected to respective edges of the pair of narrow side walls, the pair of confronting contact tongues having portions located inside the receptacle that are spaced from each other along their entire length, the pair of confronting contact tongues having free ends that contact inside surfaces of the respective end walls and the end walls having medial indentations to provide over stress protection, one of the pair of side walls consisting of a single segment that has opposite ends that are integrally attached to the respective end walls, and another of the pair of side walls comprising interlocking segments that are integrally attached solely to the respective end walls so that the rectangular receptacle does not have an open seam between any end wall and an adjacent side wall that runs an entire length of the receptacle.

6. The female terminal as defined in claim 5 wherein the interlocking segments comprises a first segment that is integrally attached solely to one of the pair of end walls and a second segment that is integrally attached solely to another of the pair of end walls, the first segment having a longitudinal interlocking tab that has an interlock shoulder that faces inwardly and the second segment having a longitudinal interlocking tab that faces outwardly and engages the interlocking shoulder of the first segment.

7. The female terminal as defined in claim 6 wherein the contact tongues of the female terminal are shaped to provide an open and controlled contact gap at a middle of the terminal to lower terminal engage force while maintaining a stable contact force, and wherein the contact tongues are shaped so that a mating blade terminal can be inserted into the receptacle from either longitudinal end.

8. The female terminal as defined in claim 5 wherein the contact tongues are bow shaped and converge to provide a controlled throat gap at a middle of the receptacle, and wherein each tongue has an aperture at the controlled throat gap and longitudinal slots in converging portions of the tongue on each side of the controlled throat gap to increase flexibility and improve electrical contact.

9. A female terminal of one-piece construction for a printed circuit board comprising, a rectangular receptacle having a pair of narrow end walls that are opposite each other and a pair of wide side walls that are opposite each other, a pair of confronting contact tongues that are integrally connected to respective edges of the pair of narrow side walls, the pair of confronting contact tongues having portions located inside the receptacle that are spaced from each other along their entire length, one of the pair of side walls consisting of a single segment that has opposite ends that are integrally attached to the respective end walls, another of the side walls comprising interlocking segments that are integrally attached solely to the respective end walls so that the rectangular receptacle does not have an open seam between any end wall and an adjacent side wall that runs an entire length of the receptacle, and solder tabs for fastening the female terminal to the printed circuit board, the solder tabs having s-shaped lateral portions integrally attached to the receptacle at inboard ends of the s-shaped lateral portions and longitudinal portions integrally attached to outboard ends of the s-shaped lateral portions, the longitudinal portions being bendable to interlock the female terminal with the printed circuit board mechanically to provide over stress protection for a solder joint between at least one of the S-shaped lateral portions of the female terminal and a conductor of the printed circuit board.

* * * * *